US006618023B2

(12) United States Patent
Park

(10) Patent No.: US 6,618,023 B2
(45) Date of Patent: Sep. 9, 2003

(54) CHIP ANTENNA

(75) Inventor: Heung-Soo Park, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/985,550

(22) Filed: Nov. 5, 2001

(65) Prior Publication Data

US 2003/0001793 A1 Jan. 2, 2003

(30) Foreign Application Priority Data

Jul. 2, 2001 (KR) ..... 2001-39336

(51) Int. Cl.[7] ..... H01Q 1/36
(52) U.S. Cl. ..... 343/895
(58) Field of Search ..... 343/895, 700 MS, 343/702

(56) References Cited

U.S. PATENT DOCUMENTS 5,633,649 A * 5/1997 Grossi et al. ..... 343/895
5,973,651 A * 10/1999 Suesada et al. ..... 343/895
6,064,351 A * 5/2000 Mandai et al. ..... 343/895
6,456,246 B2 * 9/2002 Saito ..... 343/895

FOREIGN PATENT DOCUMENTS

JP 10-093320 4/1998

* cited by examiner

*Primary Examiner*—Michael C. Wimer
(74) *Attorney, Agent, or Firm*—Lowe Hauptman Gilman & Berner, LLP

(57) ABSTRACT

A chip antenna for use in wireless LANS and in mobile communication terminals includes: a parallelepiped base block made of a dielectric material or a magnetic material, and a conductor pattern that includes a plurality of side electrodes disposed laterally on both side faces of the base block, and a plurality of upper and lower electrodes having bent portions adapted to be respectively connected to the side electrodes. The side electrodes and the upper and lower electrodes are connected together into a helix disposed around the base block. A ground terminal is disposed on the base block and is connected to a part of the conductor pattern.

8 Claims, 5 Drawing Sheets

(a)

(b)

$$B+C=1.36A$$

CHIP ANTENNA

FIELD OF THE INVENTION

The present invention relates to a chip antenna which is used in mobile communication terminals, wireless local area networks (LAN) and the like. More specifically, the present invention relates to a chip. antenna in which a vertically bent conductor pattern is disposed around a parallelepiped dielectric block so as to make it possible to miniaturize the antenna.

BACKGROUND OF THE INVENTION

Generally, conventional mobile communication apparatus include: a portable phone body, and a rod shaped antenna, the latter projecting from the top of the portable phone body. The antenna is used for transmitting and receiving the radio waves, and the resonant frequency of the antenna is determined by the total length of the antenna conductor.

However, in the antenna for the mobile communication apparatus, the antenna protrudes outside, and therefore, the antenna is affected by the ground potential. As a result, the directivity characteristics are varied, and the miniaturization of the mobile communication apparatuses is impeded.

Japanese Laid-open Patent Application No Hei-10-93320 discloses a chip antenna for solving the above described problems.

As shown in FIGS. 1(*a*) and 1(*b*) and FIG. 2, this chip antenna includes: a base block 1 made of a dielectric material; a helical conductor 2 disposed in the interior and on the surface of the base block 1; and a feeding terminal 3 disposed on the surface of the base block 1, for supplying a voltage to the conductor 2. The conductor 2 includes a capacitance-forming part 4; the capacitance-forming part 4 includes a flat part which is disposed in parallel to an open end 4*a*, so that the antenna characteristics can be maintained at a constant level.

In the above described antenna, however, if the pitch intervals of the helical conductor 2 are reduced to miniaturize the antenna, then the frequency bandwidth is decreased, with the result that the miniaturization of the antenna is impeded.

SUMMARY OF THE INVENTION

The present invention is intended to overcome the above described disadvantages of the conventional technique.

Therefore it is an object of the present invention to provide a chip antenna in which the antenna can be miniaturized without causing any variation of the antenna characteristics.

It is another object of the present invention to provide a chip antenna in which the median frequency can be lowered and the length of the conductor line can be increased without causing any reduction of the bandwidth of the antenna.

In achieving the above objects, the chip antenna according to the present invention includes:

- a parallelepiped base block of a dielectric or magnetic material;
- a conductor pattern including: (a) a plurality of side electrodes disposed laterally on both side faces of the base block; and (b) a plurality of upper and lower electrodes each having bent portions, the upper and lower electrodes adapted to respectively connect to the side electrodes, the side electrodes and the upper and lower electrodes being connected together into a helix disposed around the base block; and
- a ground terminal disposed on the base block and connected to a part of the conductor pattern.

In another aspect of the present invention, the chip antenna according to the present invention includes:

- a parallelepiped base block having a stack of dielectric or magnetic material sheets;
- a conductor pattern including: (a) a plurality of side electrodes disposed laterally on both side faces of the base block; and (b) a plurality of upper and lower electrodes each having bent portions, the upper and lower electrodes adapted to respectively connect to the side electrodes, the bent portions being lengthwisely directed, and the side electrodes and the upper and lower electrodes being connected together into a helix within the base block; and
- a ground terminal disposed on the base block and connected to a part of the conductor pattern.

BRIEF DESCRIPTION OF THE DRAWINGS

The above objects and other advantages of the present invention will become more apparent by describing in detail the preferred embodiments of the present invention with reference to the attached drawings in which.

DETAILED DESCRIPTION OF THE PREFERRED EMBODIMENTS

Figure 1:
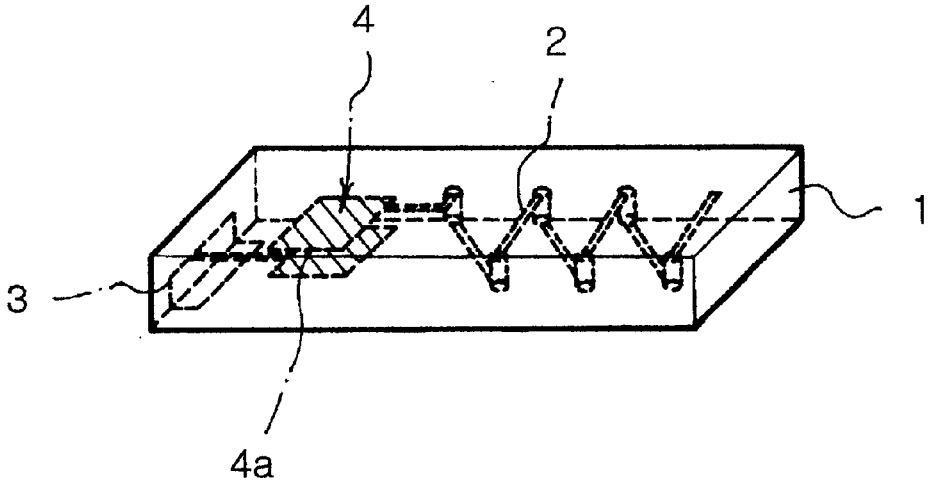
PRIOR ART FIG. 1
FIGS. 1(*a*) and 1(*b*) are perspective views showing the external appearances of a conventional chip antennas.
Figure 1:
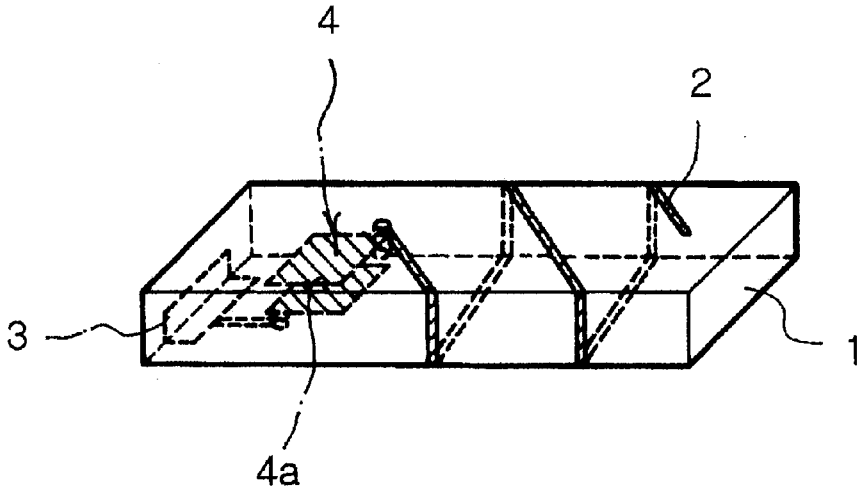
PRIOR ART FIG. 1
Figure 2:
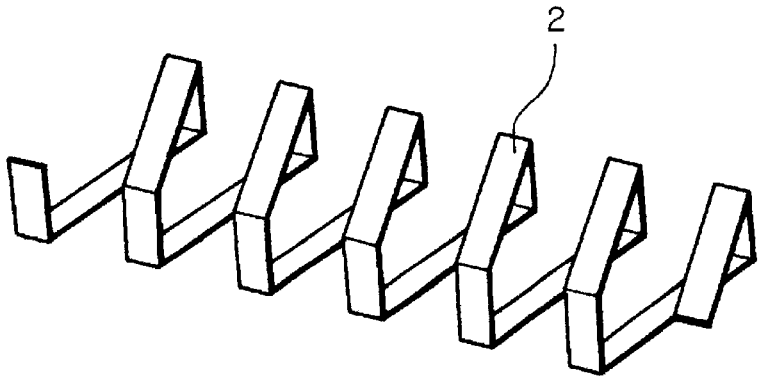
PRIOR ART FIG. 2
FIG. 2 is a perspective view of the conductor pattern of the conventional chip antenna.
Figure 3:
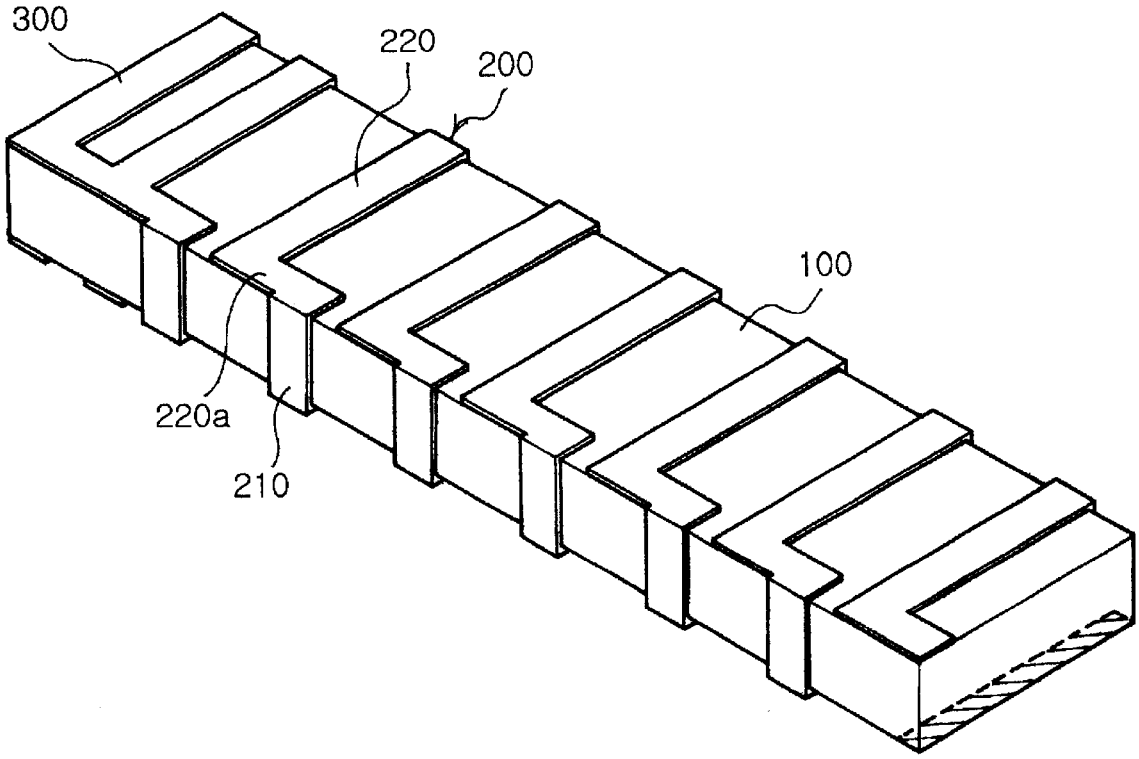
FIG. 3 is a perspective view of a chip antenna according to an embodiment of the present invention.
Figure 4:
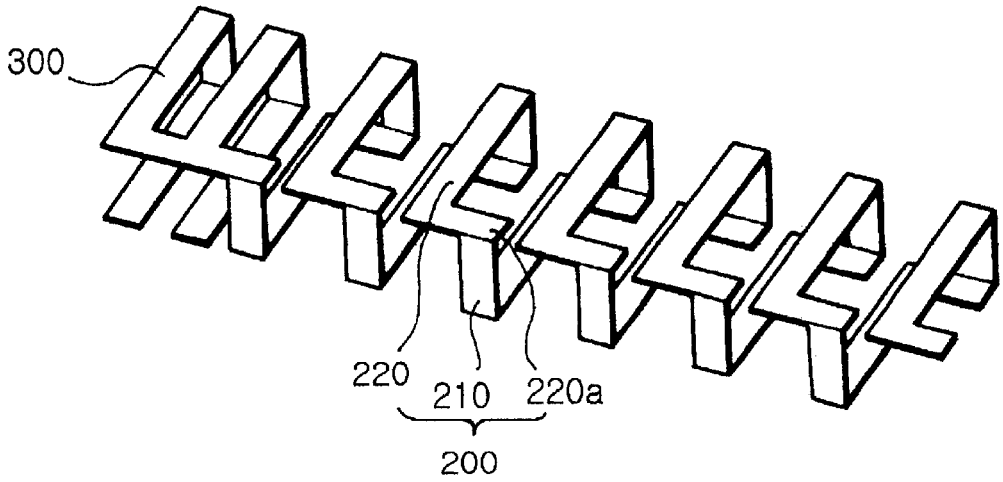
FIG. 4 is a perspective view of the conductor pattern of the chip antenna according to an embodiment of the present invention.
Figure 5:
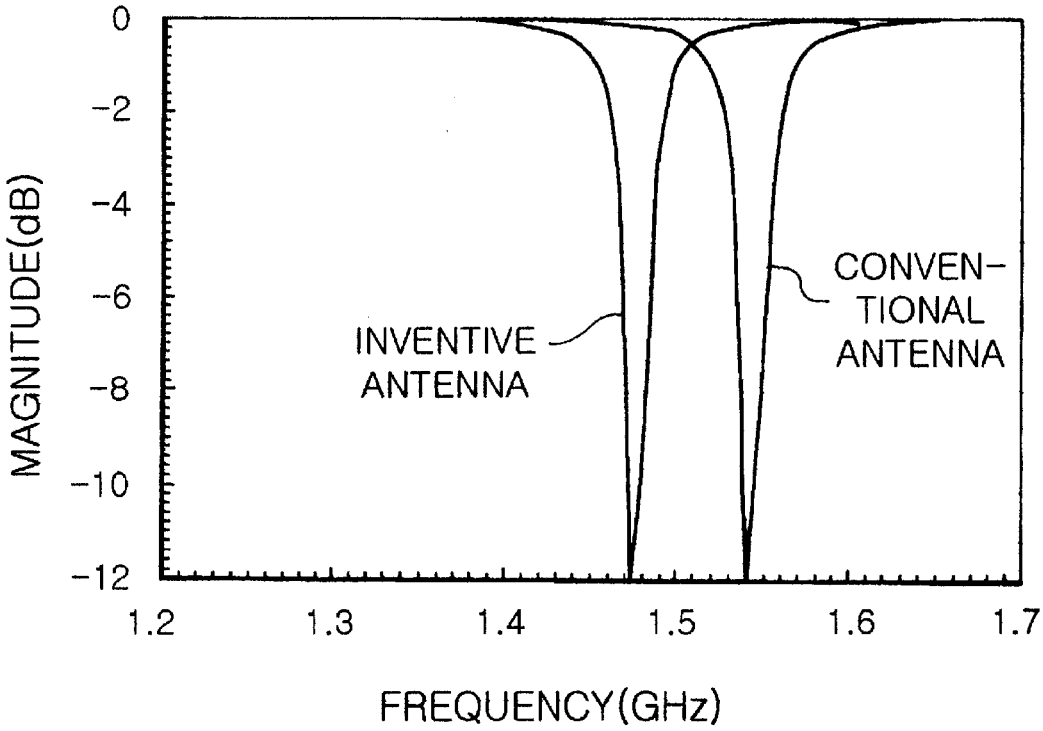
FIG. 5 is a graphical illustration comparatively showing the characteristic curves of the conventional chip antenna and the chip antenna according to an embodiment of the present invention.

The present invention will be described in detail referring to the attached drawings.

As shown in FIGS. 3 to 6, the chip antenna according to the present invention includes: a base block 100, a conductor pattern 200, and a ground terminal 300.

The base block 100 is made of a dielectric material or a magnetic material, and is a parallelepiped.

The conductor pattern 200 which is formed around the base block 100 includes: a plurality of side electrodes 210 laterally disposed on both side faces of the base block 100; and a plurality of upper and lower electrodes 220 connected together in a helix disposed around the base block 100.

Further, each of the upper and lower electrodes has a substantially rectangularly bent portion 220*a*.

The ground terminal 300 which is connected to the conductor pattern 200 is disposed on the surface of the base block 100, so that a part of the conductor pattern 200 can be connected to it.

Now the present invention will be described as to its action and effects.

As shown in FIGS. 3 to 6, the base block 100 is made of a dielectric or magnetic material, and is a parallelepiped. The plurality of the side electrodes 210, the plurality of the upper and lower electrodes 220 and the plurality of the bent portions 230*a* form the conductor pattern 200.

The conductor pattern 200 can be formed by carrying out a screen-printing or a dipping process so as to form it on the surface of the base block 100. Thus, the conductor pattern 200 is a helix that surrounds the base block 100.

Figure 6:
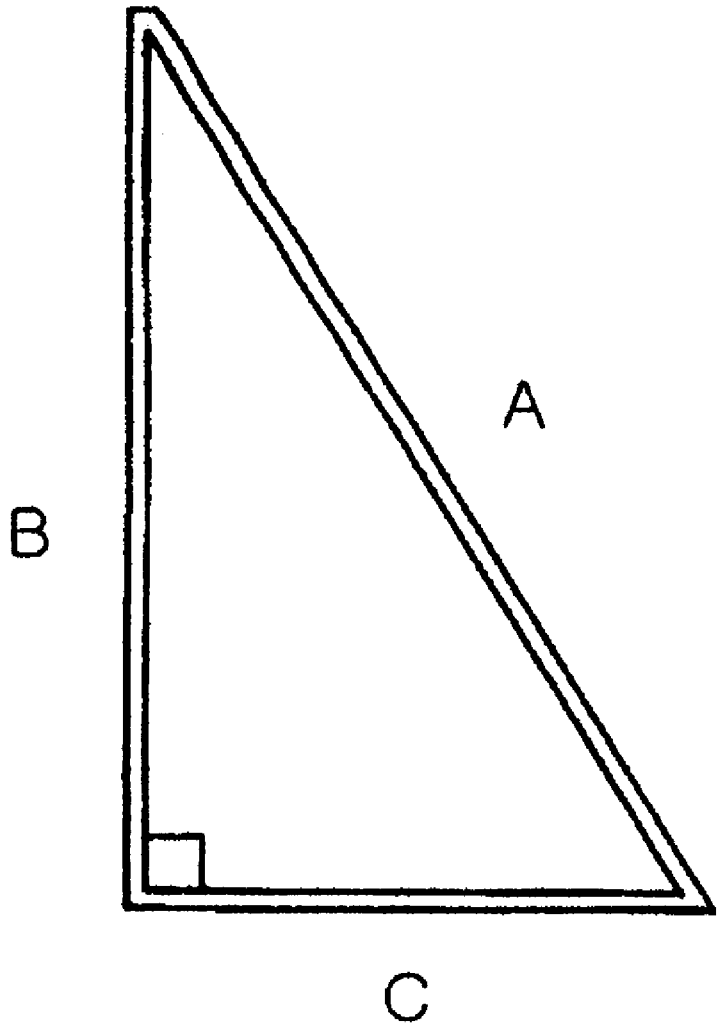
FIG. 6 comparatively illustrates the length of the conventional conductor pattern and that of the conductor pattern according to an embodiment of the present invention.

As shown in FIG. 6, owing to the bent portions 230*a*, the total length of the conductor pattern 200 including the side electrodes 210 and the upper and lower electrodes 220 is increased by about 36% compared to the conventional conductor pattern in which the bent portions are missing. As a result, the antenna can be miniaturized.

Further, the ground terminal 300 which is formed on the surface of the base block 100 and which is connected to one end of the conductor pattern 200 can serve as a part of the antenna if it is grounded to a grounding part (not illustrated) of a circuit board or the like.

The area of the ground terminal 300 which is formed on the base block 100 can be easily adjusted, and therefore, the impedance matching of the antenna can also be easily adjusted.

Figure 7:
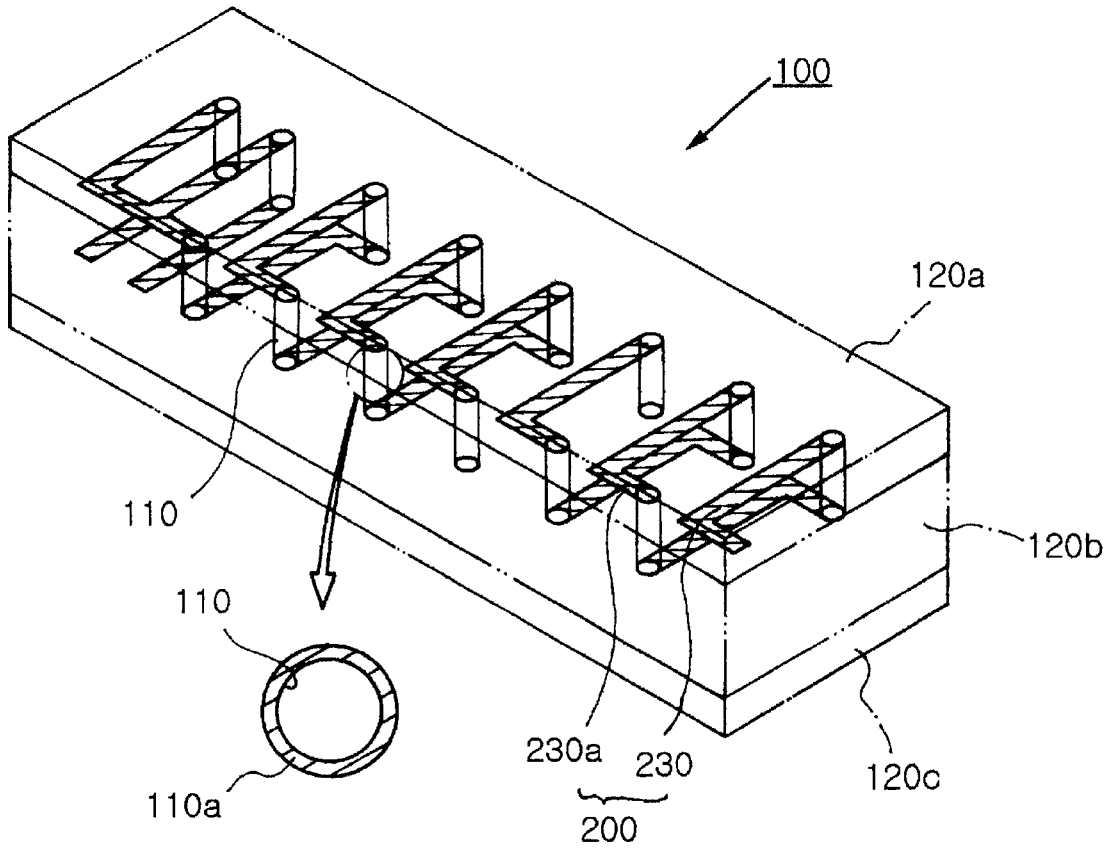
FIG. 7 is a perspective view of another embodiment of the present invention.

FIG. 7 illustrates another embodiment of the chip antenna according to the present invention. The base block 100 is formed of a stack of dielectric or magnetic material sheets 120*a*, 120*b* and 120*c*. A plurality of via holes 110 are formed in these sheets, and a conductive film 110*a* is formed on the inside of each of the via holes 110.

The conductor pattern 200 is disposed within the base block 100 which consists of the stacked sheets 120*a*, 120*b* and 120*c*. The via holes 110 are formed vertically within the stacked sheets 120*b* and 120*c*, and the bent portions 230*a* are disposed in a lengthwise direction with respect to the via holes 110. Thus, the internal electrodes 230 are connected through the via holes 110 and the bent portions 230*a*, thereby forming a helix within the base block 100.

The ground terminal 300 connected to the conductor pattern 200 is formed on the surface of the base block 100, so that a part of the conductor pattern 200 can be connected to it.

Thus, sheets 120*a*, 120*b* and 120*c* are stacked to form the base block 100. Under this condition, a plurality of the via holes 110 are formed within the stacked sheets, and a conductive film 110*a* is formed on the inside of each of the via holes 110. Further, the bent portions 230*a* and the via holes 110 connect the internal electrodes 230, thereby forming a helixl within the base block 100.

The internal electrodes 230 which are connected through the via holes 110 are completely connected through the rectangularly bent portions 230*a* which are bent at an angle substantially equal to 90 degrees. Therefore, the total length of the conductor pattern is increased by about 36% compared to the conventional conductor pattern. Accordingly, the chip antenna can be miniaturized.

Further, the area of the ground terminal 300 connected to the conductor pattern 200 can be arbitrarily adjusted. Therefore, the impedance matching can be easily adjusted.

According to the present invention as described above, the total length of the conductor pattern can be increased within the fixed volume of the antenna without the reduction of the bandwidth. Consequently, the antenna can be miniaturized, and the wave reception area is increased with the minimum volume, thereby improving the sensitivity.

In the above, the present invention was described based on the specific preferred embodiments and the attached drawings, but it should be apparent to those ordinarily skilled in the art that various changes and modifications can be added without departing from the spirit and scope of the present invention, which will be defined in the appended claims.

What is claimed is:

1. A chip antenna comprising:

a parallelepiped base block of a dielectric or magnetic material;

a conductor pattern comprising: (a) a plurality of side electrodes disposed laterally on both side faces of the base block; and (b) a plurality of upper and lower electrodes each having bent portions, the upper and lower electrodes adapted to respectively connect to the side electrodes, the side electrodes and the upper and lower electrodes being connected together into a helix disposed around the base block; and a ground terminal disposed on the base block and connected to a part of the conductor pattern.

2. The chip antenna as claimed in claim 1, wherein the side electrodes are disposed vertically relative to upper and lower faces of the base block.

3. The chip antenna as claimed in claim 1, wherein the bent portions of the conductor pattern have bent angles substantially equal to 90 degrees.

4. The chip antenna as claimed in claim 1, wherein the upper and lower electrodes are L-shaped, the upper and lower electrodes adapted to connect to the side electrodes.

5. A chip antenna comprising:

a parallelepiped base block having a stack of dielectric or magnetic material sheets;

a conductor pattern comprising: (a) a plurality of side electrodes disposed laterally on both side faces of the base block; and (b) a plurality of upper and lower electrodes each having bent portions, the upper and lower electrodes adapted to respectively connect to the side electrodes, the bent portions being lengthwisely directed, and the side electrodes and the upper and lower electrodes being connected together into a helix disposed within the base block; and a ground terminal disposed on the base block and connected to a part of the conductor pattern.

6. The chip antenna as claimed in claim 5, wherein the side electrodes are disposed vertically relative to upper and lower faces of the base block.

7. The chip antenna as claimed in claim 5, wherein the bent portions of the conductor pattern have bent angles substantially equal to 90 degrees.

8. The chip antenna as claimed in claim 5, wherein the upper and lower electrodes are L-shaped, the upper and lower electrodes adapted to connect to the side electrodes.

* * * * *